United States Patent [19]

Van Huyssteen

[11] Patent Number: 4,649,673

[45] Date of Patent: Mar. 17, 1987

[54] SHOT BLASTING WHEELS

[76] Inventor: Jan H. H. Van Huyssteen, 148 Rivonia Road, Sandton, Transvaal, South Africa

[21] Appl. No.: 676,387

[22] Filed: Nov. 29, 1984

[30] Foreign Application Priority Data

Nov. 29, 1983 [ZA] South Africa ..... 83/8879

[51] Int. Cl.[4] ..... B24C 5/06

[52] U.S. Cl. ..... 51/434; 51/435

[58] Field of Search ..... 29/282; 51/434, 435, 51/431; 411/531, 368, 546

[56] References Cited

U.S. PATENT DOCUMENTS

| | | | |
|---|---|---|---|
| 2,582,702 | 1/1952 | Keefer | 51/9 |
| 3,287,858 | 11/1966 | Moore et al. | 51/9 |

FOREIGN PATENT DOCUMENTS

| | | | |
|---|---|---|---|
| 347382 | 10/1919 | Fed. Rep. of Germany | 411/531 |
| 2009562 | 9/1971 | Fed. Rep. of Germany . | |
| 2348903 | 4/1975 | Fed. Rep. of Germany | 411/531 |
| 2185950 | 1/1974 | France . | |
| 545650 | 6/1942 | United Kingdom . | |
| 985743 | 3/1965 | United Kingdom . | |
| 1390958 | 4/1975 | United Kingdom . | |
| 1484037 | 8/1977 | United Kingdom . | |

*Primary Examiner*—Robert P. Olszewski
*Assistant Examiner*—Maurina Rachuba
*Attorney, Agent, or Firm*—Finnegan, Henderson, Farabow, Garrett & Dunner

[57] ABSTRACT

The invention provides a novel shot blasting wheel having a base plate with angularly spaced elongated grooves therein into which complementary tongue formations on shot accelerating blades engage with a rearwardly directed lug being provided on each blade which is engaged by a bolt or stud, such lug including a wedging surface which results in a locking force on the lug normal to the base plate and parallel thereto to lock the tongue formation in the groove. The interengaged tongue and groove shielded against the ingress of shot by lands, lips or the like on the bottom surface of the blades, which are in close contact with the base plate.

15 Claims, 8 Drawing Figures

SHOT BLASTING WHEELS

This invention relates to shot blasting wheels, by which is meant wheels equipped with radially directed vanes which propel shot blasting particles radially outwardly on to elements which are to be subjected to shot blasting.

There are several different patterns of such wheels, some single flanged and some double flanged. In both designs the blades are housed in radially disposed slots running from the outer diameter of such wheels to an inner circular cavity which is provided to facilitate machining. In the final assembly the cavity is fitted with what is commonly known as a centering plate which, in effect, becomes part of the wheel again.

Slots are provided in single flange wheels which are normally dove-tail in shape for housing the mating edges of the blades which have a similar shape.

In the case of double flange wheels the blades are normally located in radial grooves of rectangular shape on the inner surface of the flanges.

1. Blades can only be removed after dismantling of the feed spout which provides the wheel with shot, the distributor which meters out the shot to each blade, the impeller which feeds the shot to the control cage and finally the centering plate filling the inner cavity described above.

2. After removal of components in (1) above, the blades do not automatically become free as they are jammed tight with shot. Blades have forcefully to be removed radially inwardly by hammering with a heavy object. Changing blades is normally done by two people.

3. Because the radial grooves, housing the blades have to provide clearances to accept the blades and since these latter elements are castings, they generally provide passages of varying section for the shot to travel along and cause excessive wear.

According to the invention a shot blasting wheel comprises a circular base plate, defining a plurality of locating formations; shot accelerating blades defining complementary locating formations in engagement with the formations on the base, so that the blades are generally radially located and angularly spaced from one another, and securing means to secure the blades releasably to the base, the arrangement being one wherein the interengaged locating formations are substantially sealed to prevent the ingress of shot.

Preferably the locating formations will be elongated tongue and groove formations, although the invention also contemplates the possiblity that the locating formations could be comprised by spigot and socket formations. For ease of machining it will will be preferred that the groove formations be defined in the base plate while tongue formations will project from the bottom surface of the blades which will normally be in the form of castings.

Further according to the invention the interengaged locating formations will be sealed against the ingress of shot by lands, lips or the like on the bottom surface of the blade, such lands and lips flanking the locating formations. In a preferred arrangement where the locating formations on the blade is an elongated tongue, such tongue will terminate short of the ends of the bottom surface of the blade so that such ends will define sealing lands. Preferably longitudinal lips will also flank the longitudinal side of the tongue formation.

It is envisaged that the securing means will include a wedging surface adapted to exert a wedging force on the blades in the direction of the plane of the base plate, and the locating formations will include abutment surfaces which are brought into close engagement by the wedging force. These abutment surfaces could be under cut or angled to perform a locking action on the blades if desirable. Preferably however the abutment surfaces will be elongated flat surfaces substantially normal to the plane of the base plate. Thus in one arrangement the locating formations could be of quarter-circular cross-section with the abutment surfaces defined by the side of the quarter circle such side preferably being normal to the plane of the base plate. Preferably also the locating formations will be elongated and have rounded shoulders at the longitudinal ends thereof. It is believed that such formations will minimize the possibility of jamming of the blades.

The securing means in accordance with the invention will comprise a rearwardly projecting lug and a threaded bolt of stud which engages the lug to secure the blade to the base. Preferably the lug will be in the form of a saddle which defines an angled wedging surface relative to the plane of the base plate which is engaged by a complementary surface on the bolts, stud or the like so that a component of force normal to the base plate and one parallel thereto is exerted on the blade. The invention also envisages a quick release device for the securing formation comprising a ferrule having a bore through which the bolt or stud passes and which defines an outer surface adapted to engage the wedging surface of the lug. In a preferred arrangement the outer surface will include an interruption therein so that the ferrule can selectively engage or be disengaged from the wedging surface of the lug for removal purposes. The complementary outer surface of the ferrule could also define a wedging surface of progressive eccentricity or one which is helically disposed or longitudinally stepped, for quick release purposes. For release purposes it is also preferred to bias the ferrule away from the surface of the base plate by means of a spring, bent washer or the like.

Included separately within the scope of the invention are the various elements of the wheel namely the blade, base and ferrule as disclosed herein.

To illustrate the invention some examples are described hereunder with reference to the accompanying drawings in which.

Figure 1:
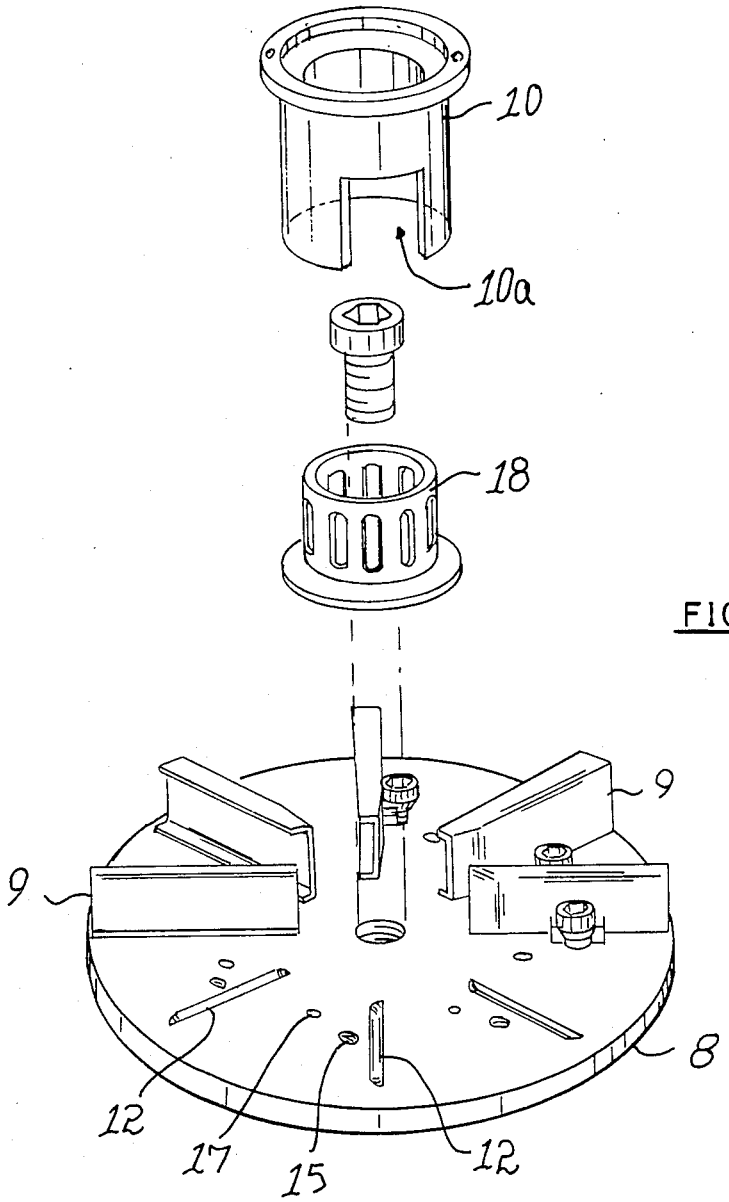
FIG. 1 is a diagrammatic view of the wheel of the invention with some blades removed.

Referring to the drawings, the wheel includes a circular solid base or flange 8 to which is secured a number of radial circumferentially spaced throwing blades 9.

A distributor 10 suitably slotted at 10*a* receives shot from an axial inlet, not shown, and introduces the shot radially to the blades 9*a*. The blades 9 will accelerate the shot outwardly by centrifugal action towards elements being subjected to shot blasting. An inner-impeller 18 which receives shot from the inlet and feeds the shot to the distributor 10 will be anchored centrally on the base plate or flange 8.

Each of the blades 9 is characterised in an anchoring tongue 11 which fits snugly into a mating groove 12 in the flange 8 and is held in position by means of a suitable anchoring bolt 13. In the illustrated arrangement of the invention a bifurcated lug 14 projects rearwardly from the back of the blade with the arms of the lug flanking a threaded orifice 15 in the flange. A ferrule 16 is neatly accommodated within the arms of the lug and as the bolt 13 is turned up in orifice 15 so the ferrule is caused to enhance the anchoring of the blade on the flanges 8 as described below in more detail. Preferably the ferrule is designed so that minimum turning up of the bolt 13 is required to effect the necessary anchoring of the blade on the flange.

It will be noted from FIGS. 2, 4, 6 and 7 that the lug 14 includes an angled wedging surface 14*a* which will be engaged by a complementary surface 16*b* on the ferrule 16 so that when the bolt 13 is tightened a component of force normal to the base 8 and a component parallel to the plane of the base 8 will act on the lug 14. In the arrangement illustrated the tongue 11 defines a flat 11*b* which is opposed to the wedging surface 14*a* of the lug 14 and which will therefor be forced into secure engagement with a mating flat in the groove 12, FIG. 2. If required the flat 11*b* could be angled to wedge into an over hanging or undercut surface in the groove 12. The side of the tongue 11 opposed to the flat 11*b* will be angled or rounded, FIG. 2, and it is believed that such a profile will minimize the possibility of jamming of the tongue 11 in the groove 12 as a result of the ingress of shot.

Figure 5:
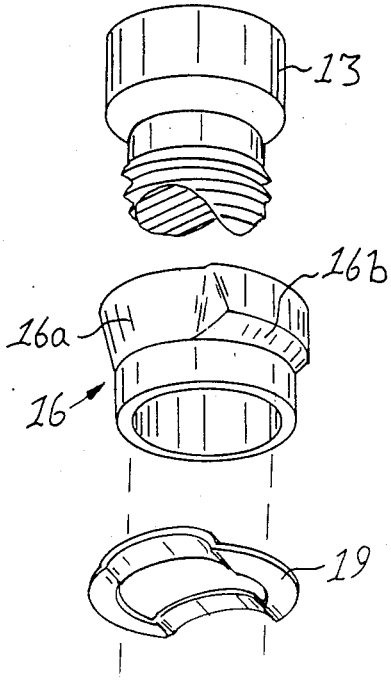
FIG. 5 is a perspective of a locking bolt and ferrule for securing a blade to the flange.
Figure 8:
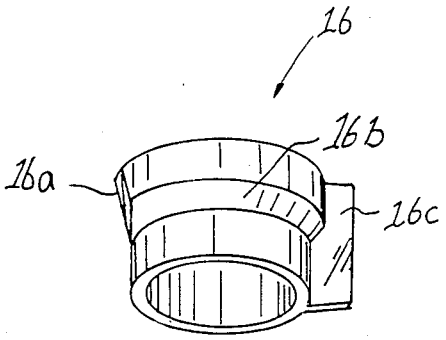
FIG. 8 is a different perspective view of the ferrule in FIG. 5.

With reference to FIG. 5 the outer surface of the ferrule 16 includes an interruption at 16*a* in the wedging surface 16*b*. Thus upon tightening of the bolt 13 the ferrule 16 will be rotated so that the surface 16*b* engages the wedging surface 14*a*. During loosening on the otherhand the ferrule 16 will be rotated so that the surface 16*a* aligns with the wedging surface 14*a* which will permit the blade 9 to be pivoted about the tongue 11 and removed from the base 8 without removal of the bolt 13. In an alternative arrangement, not shown, the wedging surface defined by the ferrule 16 could have a progressive eccentricity or be arranged helically so that upon tightening of the bolt 13 the wedging surface on the ferrule will run up the surface 14*a* to lift the ferrule 14 off the surface of the plate 8 to lessen the amount of tightening required of the bolt 13. The reverse will occur upon loosening of the bolt 13. In order to facilitate rotation of the ferrule 16 an ear formation 16*c* could be provided as illustrated. It is also envisaged that the ferrule 16 will be biased away from the surface of the base plate 8 by means of a spring washer, compression spring or the like 19 to facilitate removal of the blade 9.

Figure 2:
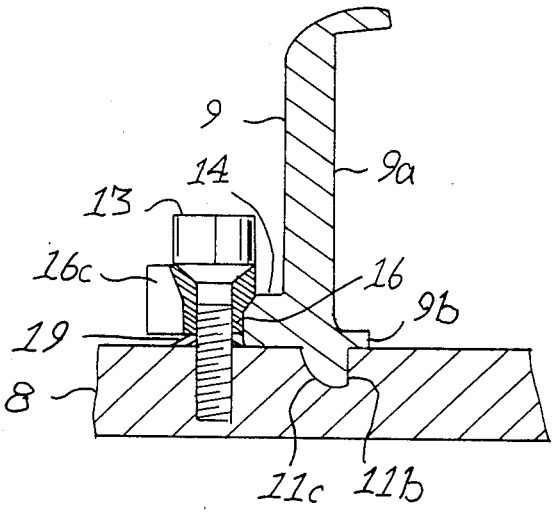
FIG. 2 is a fragmentary view in vertical section through the wheel.
Figure 4:
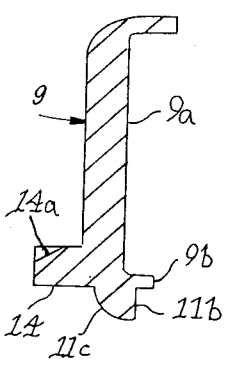
FIG. 4 is a side elevation of a blade.
Figure 3:
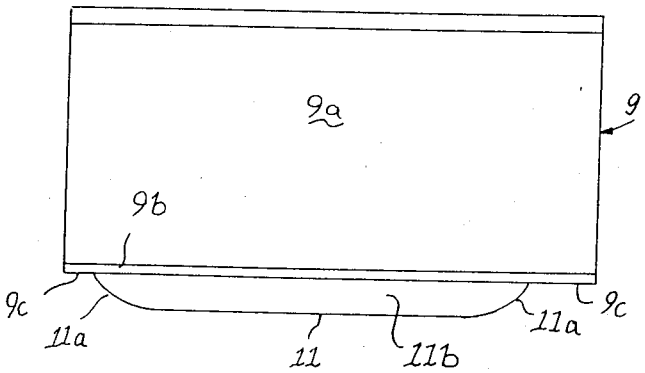
FIG. 3 is a front elevation of a blade.
Figure 7:
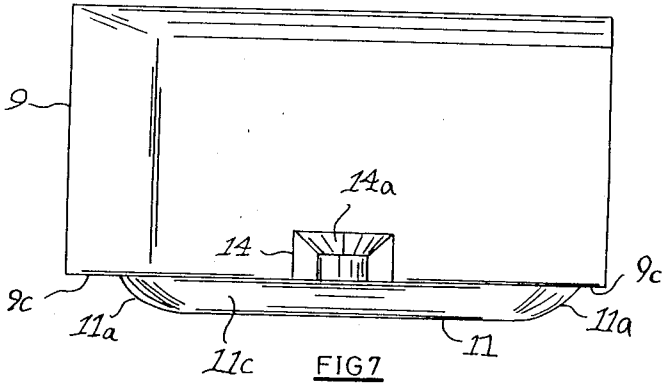
FIG. 7 is a back view of a blade.
Figure 6:
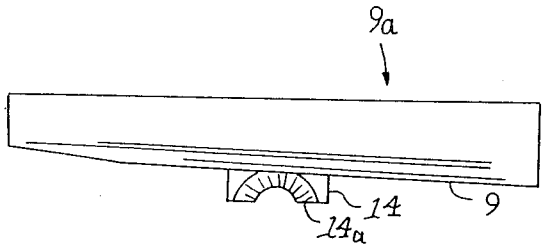
FIG. 6 is a vertical plan of a blade.

A further feature of the invention provides for the groove 12 to be masked to minimize the ingress of shot for this purpose the bottom surface of the blade 9 which engages the base 8 will terminate at each end in a land 9*c* adapted to shield the longitudinal ends of the groove 12. Preferably the groove 12 will also be shielded in a lateral sense with a lip formation 9*b* being provided to project beyond the tongue 11 on the one side thereof while on the otherside of the tongue 11 the bottom surface of the blade 9 will perform a shielding function as shown in FIG. 2.

Preferably cross-sectional profile of the tongue 11 will be of quarter-circular shape to permit easy separation from the groove 12. Preferably the longitudinal profile of the tongue 11 will also be shaped to facilitate removal from the groove 12 and will preferably terminate in rounded shoulders 11*a* at the longitudinal ends thereof.

The advantages derived by using the wheel of the invention include the extreme ease with which a blade may be removed from the flange or base. It should be unnecessary to remove the inner impeller 18, the stationary distributor 10 and the inlet duct, not shown. Furthermore, with the grooves 12 being masked from the region of the impeller it is anticipated that wear through the action of the shot should be sensibly reduced.

Variations in the shape of the blades or the shape of the anchoring lug at the back of a blade may be made without departing from the essentials of the invention.

The wheel is housed in a suitable case and normally projects the shot downwardly on to the elements requiring shot blasting.

The invention aims at accomplishing the following:

(a) Diminished wear by asking or eliminating changes in section. This is achieved by the bottom surface of the blade covering and overlapping the locating groove.

(b) Making it difficult for the shot to pack up and jam the blade. This is achieved by the special shape of the groove which makes the blade come loose as soon as it is mechanically released.

(c) A quick release and tightning mechanism by way of a specially formed ferrule which presents a different face to the clamping shoulder of the blade when turned through, say, 90°.

The tapped holes 17 are for securing the wheel to a driving hub or the like and the holes may in fact be masked from the shot by locating them close up to the backs of the blades. Preferably a shoulder of the rearwardly projecting lug 14 is designed to overlap the associated tapped hole 17.

I claim:

1. A shot blasting wheel adapted for delivering shot through centrifical action comprising a circular base plate defining a plurality of generally radially disposed grooves, shot accelerating blades each having a base adapted to seat on the base plate and including a tongue projecting from the base and adapted for complementary engagement with the grooves on the base so that the blades are generally radially disposed in angularly spaced relationship with the tongue of each blade and groove producing a sealing engagement preventing ingress of shot, and securing means for securing each blade releasably to the base plate, said securing means comprising a wedging surface adapted to upon tightening of the securing means exert a wedging force on the blade in a direction toward the base plate, each tongue and groove including a longitudinal abutting surface adapted for mutual tight engagement upon application of the wedging force to produce a locking action, said abutting surfaces being disposed substantially normal to the base plate and opposite to the wedging surface of the securing means, with said tongue and said groove upon said securing each further including a surface opposing the abutting surfaces and angled from an extremity of the abutting surfaces to the base toward the wedging surface with the wedging surface upon tightening of the securing means exerting a force on the blade in a direction normal to the base plate.

2. The slot blasting wheel according to claim 1 wherein each tongue and each groove are elongated and have tapered shoulders at longitudinal ends thereof.

3. The shot blasting wheel according to claim 1 wherein the securing means comprises a ferrule having a bore, a bolt adapted for tightening within said bore and into said base plate, said ferrule further including an inner wedging surface angled relative to said base plate, said inner wedging surface adapted for engagement with a complementary surface of said bolt when said bolt is tightened within said bore and into said base plate and said ferrule further including an outer wedging surface adapted to engage a complementary wedging surface of a lug extending from the base of said blade and onto said base plate, said wedging surface of said lug being angled relative to said base plate.

4. The shot blasting wheel accoording to claim 3 wherein the outer wedging surface on the ferrule as a circumferentially interrupted area to permit disengagement from the wedging surface of the lug at the interrupted area.

5. The shot blasting wheel according to claim 3 wherein the securing means further includes biasing means adapted to bias the ferrule away from the surface of the base plate.

6. The shot blasting wheel according to claim 1 wherein the base of the blade includes a bottom surface having an exension adapted to overlap said groove at said base plate.

7. The shot blasting wheel according to claim 6 wherein said extension includes a land at each end of the blade.

8. The shot blasting wheel according to claim 1 wherein said tongue and said groove are each quarter-circular in cross-section.

9. The shot blasting wheel according to claim 1 wherein each tongue and each groove are elongated and have rounded shoulders at longitudinal ends thereof.

10. A shot blasting wheel according to claims 6, 7, 8, 9, 4, 5, 1, 2 or 3 wherein said blade includes a bottom surface adapted to contact said base plate, said tongue projecting from said bottom surface to engage said groove.

11. The blade according to claim 10 wherein the tongue is elongated and terminates short of each end of the bottom surface of the blade.

12. The blade according to claim 11 wherein each end of the tongue terminates in rounded shoulders.

13. The blade according to claim 10 wherein the tongue is generally quarter-circular in cross-section with a flat portion thereof being substantially normal to the bottom surface of the blade.

14. The blade according to claim 10 wherein said grooves are elongated and have a length shorter then a bottom surface of a blade seated on the base plate.

15. The blade according to claim 10 wherein each said groove is of quarter circular cross-section having a flat portion substantially normal to the base plate.

* * * * *